US009457929B2

(12) United States Patent
Jenkins

(10) Patent No.: US 9,457,929 B2
(45) Date of Patent: Oct. 4, 2016

(54) LEAKAGE-RESISTANT PACKAGING

(75) Inventor: Kenneth T. Jenkins, Old Forge, PA (US)

(73) Assignee: Pratt Corrugated Holdings, Inc., Conyers, GA (US)

( * ) Notice: Subject to any disclaimer, the term of this patent is extended or adjusted under 35 U.S.C. 154(b) by 11 days.

(21) Appl. No.: 13/556,286

(22) Filed: Jul. 24, 2012

(65) Prior Publication Data

US 2013/0026059 A1 Jan. 31, 2013

Related U.S. Application Data

(60) Provisional application No. 61/511,984, filed on Jul. 26, 2011.

(51) Int. Cl.

| | |
|---|---|
| ***B65D 5/24*** | (2006.01) |
| ***B65D 5/56*** | (2006.01) |
| ***B65B 11/00*** | (2006.01) |
| ***B65B 11/02*** | (2006.01) |

(52) U.S. Cl.

CPC ..... *B65D 5/242* (2013.01); *B65B 11/004* (2013.01); *B65B 11/02* (2013.01); *B65D 5/563* (2013.01)

(58) Field of Classification Search

CPC ..... A01K 1/0125; B65D 5/244; B65D 5/24; B65D 5/241; B65D 5/243; B65D 5/247; B65D 5/242; B65D 5/4266

USPC ..... 296/186; 229/186, 187

See application file for complete search history.

(56) References Cited

U.S. PATENT DOCUMENTS

| | | | | |
|---|---|---|---|---|
| 1,959,613 | A * | 5/1934 | Carson | 229/186 |
| 2,007,810 | A | 7/1935 | Oman et al. | |
| 2,008,443 | A * | 7/1935 | Froehlig | 229/117.14 |
| 2,120,902 | A * | 6/1938 | Moore | 493/129 |
| 2,147,503 | A | 2/1939 | Seifer et al. | |
| 2,269,013 | A | 1/1942 | Dorfman et al. | |
| 2,643,812 | A * | 6/1953 | Lange | 229/186 |
| 2,805,813 | A | 9/1957 | Rittmueller et al. | |
| 3,131,849 | A | 5/1964 | Paige | |
| 3,140,037 | A * | 7/1964 | Baum et al. | 229/125.19 |
| 3,140,813 | A | 7/1964 | Hall et al. | |
| 3,193,176 | A | 7/1965 | Gullickson et al. | |
| 3,194,480 | A | 7/1965 | Maindron et al. | |
| 3,246,829 | A | 4/1966 | Sexton et al. | |
| 3,254,827 | A | 6/1966 | Chapman | |
| 3,316,102 | A * | 4/1967 | Doll et al. | 426/129 |
| 3,423,007 | A * | 1/1969 | Christensson | 229/120 |
| 3,465,948 | A | 9/1969 | Boyer | |
| 3,497,924 | A * | 3/1970 | Lock | 229/198.2 |
| 3,658,234 | A * | 4/1972 | Deckys | 229/151 |
| 3,669,340 | A * | 6/1972 | Kinney | 229/170 |
| 3,701,467 | A * | 10/1972 | Johansson et al. | 206/518 |
| 3,780,934 | A | 12/1973 | Gardner | |

(Continued)

OTHER PUBLICATIONS

Jenkins; U.S. Provisional Application entitled: Leakage-Resistant Packaging, having U.S. Appl. No. 61/511,984, filed Jul. 26, 2011, 9 pgs.

*Primary Examiner* — Fenn Mathew
*Assistant Examiner* — Chetan Chandra
(74) *Attorney, Agent, or Firm* — Taylor English Duma LLP

(57) ABSTRACT

Leak-resistant packaging includes at least one bottom panel; at least one side panel, each side panel in leak-resistant arrangement with the bottom panel; and at least one support in leak-resistant arrangement with the bottom panel and the at least one side panel.

24 Claims, 3 Drawing Sheets

(56) References Cited

U.S. PATENT DOCUMENTS

| | | | | | |
|---|---|---|---|---|---|
| 3,810,574 | A | * | 5/1974 | Gardner | 229/170 |
| 3,833,113 | A | * | 9/1974 | Osier | 206/216 |
| 3,885,730 | A | * | 5/1975 | Christensson | 229/125.05 |
| 3,886,901 | A | * | 6/1975 | Zeitter | 119/168 |
| 3,917,155 | A | * | 11/1975 | Bemiss | 229/169 |
| 3,927,824 | A | | 12/1975 | Razziano | |
| 4,019,675 | A | * | 4/1977 | Andersson et al. | 229/125.17 |
| 4,068,795 | A | * | 1/1978 | Forster | 229/144 |
| 4,119,265 | A | | 10/1978 | Dlugopolski | |
| 4,171,763 | A | | 10/1979 | Card | |
| 4,174,051 | A | | 11/1979 | Edwards et al. | |
| 4,176,423 | A | | 12/1979 | Wigemark | |
| 4,238,069 | A | | 12/1980 | Morris, Jr. | |
| 4,260,098 | A | * | 4/1981 | Manizza et al. | 229/171 |
| 4,328,923 | A | | 5/1982 | Graser | |
| 4,340,169 | A | * | 7/1982 | Webinger | 229/101 |
| 4,403,728 | A | | 9/1983 | Koltz | |
| 4,465,227 | A | * | 8/1984 | Hood et al. | 229/135 |
| 4,607,786 | A | | 8/1986 | Weaver | |
| 4,687,130 | A | * | 8/1987 | Beeler | 229/114 |
| 4,784,497 | A | * | 11/1988 | Dutton | 383/43 |
| 4,830,271 | A | | 5/1989 | Lau et al. | |
| 4,895,250 | A | | 1/1990 | Schifrin | |
| 4,951,868 | A | * | 8/1990 | Mode | 229/112 |
| 5,016,813 | A | * | 5/1991 | Simons | 229/189 |
| 5,018,663 | A | | 5/1991 | Corso | |
| 5,020,337 | A | | 6/1991 | Krieg | |
| 5,033,668 | A | * | 7/1991 | Cohen et al. | 229/186 |
| 5,042,715 | A | | 8/1991 | McNeil | |
| 5,050,766 | A | | 9/1991 | Groh | |
| 5,062,527 | A | | 11/1991 | Westerman | |
| 5,074,460 | A | | 12/1991 | Hanekamp | |
| 5,094,359 | A | | 3/1992 | DeMars et al. | |
| 5,249,550 | A | * | 10/1993 | Hines et al. | 119/168 |
| 5,263,339 | A | | 11/1993 | Evans | |
| 5,284,294 | A | * | 2/1994 | Floyd | 229/179 |
| 5,303,863 | A | | 4/1994 | Arasim | |
| 5,307,986 | A | * | 5/1994 | Schuster | 229/186 |
| 5,392,984 | A | | 2/1995 | Yocum | |
| 2,714,982 | A | | 8/1995 | Strauss et al. | |
| 5,562,228 | A | | 10/1996 | Ericson | |
| 5,839,652 | A | * | 11/1998 | Ben-Haim | 229/240 |
| 5,853,121 | A | | 12/1998 | Francisco | |
| D406,235 | S | * | 3/1999 | Barnes et al. | D9/433 |
| 5,881,949 | A | * | 3/1999 | Focke | 229/125.31 |
| 6,092,720 | A | * | 7/2000 | Karolyi | 229/169 |
| 6,164,526 | A | * | 12/2000 | Dalvey | 229/101 |
| 6,253,993 | B1 | * | 7/2001 | Lloyd et al. | 229/117.3 |
| 6,273,847 | B1 | * | 8/2001 | MacLean et al. | 493/55 |
| 6,676,010 | B1 | * | 1/2004 | Roseth et al. | 229/114 |
| 6,736,309 | B1 | * | 5/2004 | Westerman et al. | 229/117.05 |
| 6,837,420 | B2 | * | 1/2005 | Westerman et al. | 229/117.15 |
| 7,523,854 | B2 | * | 4/2009 | Gray | 229/114 |
| 7,748,603 | B2 | * | 7/2010 | Fogle et al. | 229/101 |
| 7,841,512 | B2 | * | 11/2010 | Westerman et al. | 229/125.28 |
| 2005/0279816 | A1 | * | 12/2005 | Kao | 229/186 |
| 2006/0122318 | A1 | * | 6/2006 | Jho et al. | 524/501 |
| 2007/0090172 | A1 | * | 4/2007 | Lyon et al. | 229/5.84 |
| 2008/0173704 | A1 | * | 7/2008 | Forthaus et al. | 229/117.24 |

* cited by examiner

LEAKAGE-RESISTANT PACKAGING

CROSS-REFERENCE TO RELATED APPLICATIONS

This application claims the benefit of U.S. Provisional Application 61/511,984 filed on Jul. 26, 2011, which is hereby incorporated herein in its entirety by reference.

FIELD

This disclosure relates to packaging. More particularly, this disclosure relates to packaging that resists leakage.

BACKGROUND

In manufacturing environments, packaging is often important. Different styles of packaging fit different applications. In one application, products are packaged in a manufacturing line. In hopes of providing a fast manufacturing process, bliss boxes are often used, wherein a product is not removed from the manufacturing line to be packaged, but, instead, packaging is applied to the product. However, bliss boxes often include seams between separate pieces where packaging contents can escape. In most bliss boxes, seams are included on at least one side of the bliss box. If seams unseat, even to a small degree, the contents of the bliss box may be exposed to the elements or may leak out of the bliss box. Particularly where fluids are contained inside the bliss box, such as with food packaging, the risk of spillage or contamination of the contents of the packaging remains a risk.

SUMMARY

Disclosed is leak-resistant packaging. The packaging includes at least one side panel and at least a bottom panel.

DESCRIPTION OF THE FIGURES

The features and components of the following figures are illustrated to emphasize the general principles of the present disclosure and are not necessarily drawn to scale. Corresponding features and components throughout the figures may be designated by matching reference characters for the sake of consistency and clarity.

DETAILED DESCRIPTION

Figure 1:
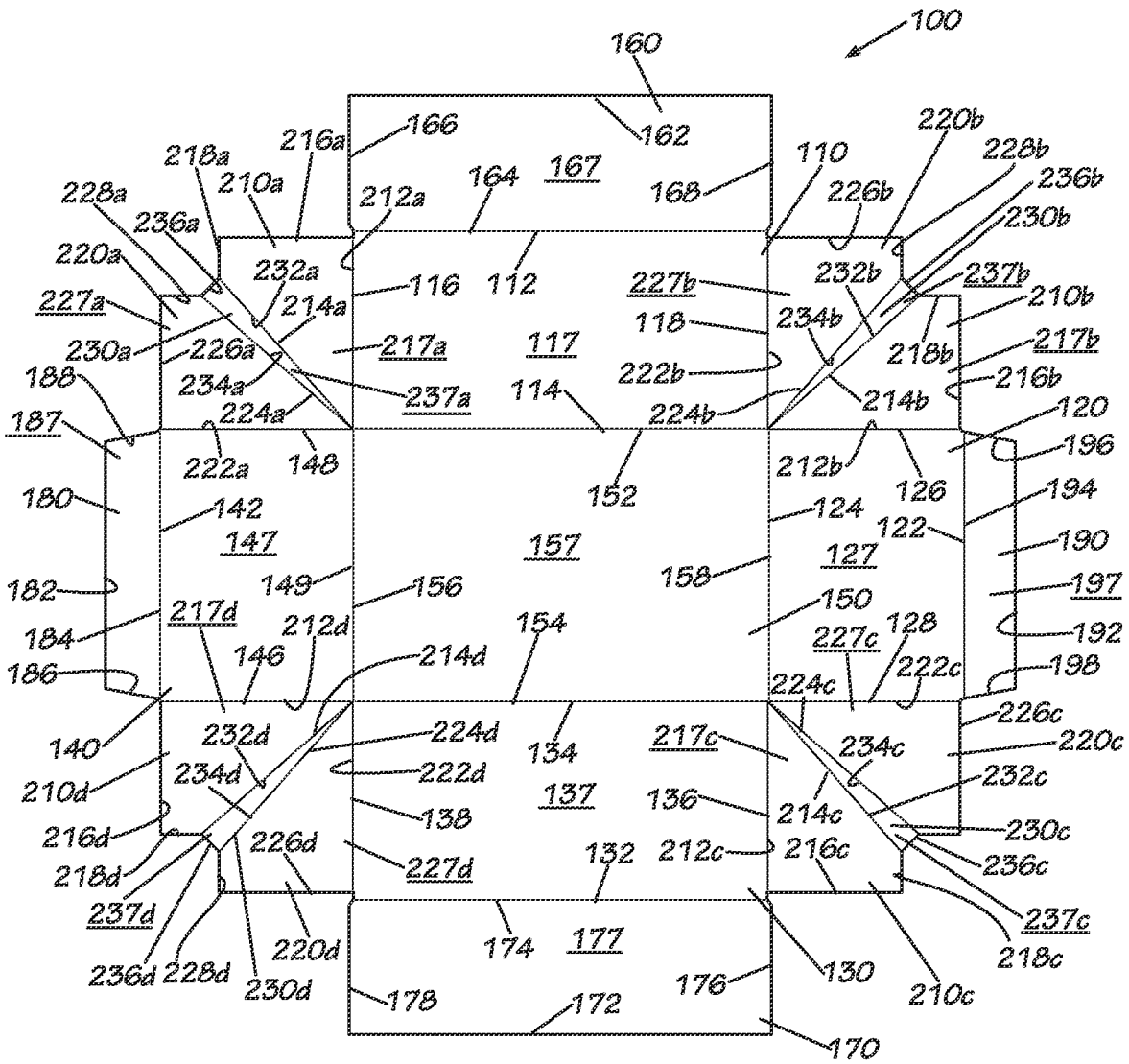
FIG. 1 is a schematic view of a blank formable into leak-resistant packaging in accord with one embodiment of the disclosure.

FIG. 1 shows a blank formable into one embodiment of the disclosed packaging 100. Dimensions in this disclosure are provided by way of example only and are not intended to be limiting on the scope of this disclosure or any claims flowing therefrom.

As seen in FIG. 1, the packaging 100 of the current embodiment is provided in blank form. The packaging 100 may be provided in assembled state in some embodiments. The packaging 100 is made of corrugated paper in the current embodiment. In the current embodiment, the performance specification is Ect 40. The performance specification includes end-crush test requirements. Other specifications may be used on other embodiments. The flute of the corrugated paper of the current embodiment is C-flute, although other flutes may be used in other embodiments, including B-flute and combined flutes. The flute refers to the thickness of the blank. The color is craft packaging, but may be various colors in various embodiments, and may include packaging graphics or logos. Other materials may be used as well, including metal, plastic, wood, cardboard or paper, resin, Styrofoam, linerboard, polymer, alloy, mesh, laminate, reinforced woven or nonwoven fabric, cellulose, composite, and combinations or mixtures of the foregoing, among others. Although the packaging 100 is one-piece formed blank in the current embodiment, various embodiments may include more than one piece with coating, liner, tight-fitting assembly, or various other arrangement to make the packaging 100 leak-resistant. The corrugated paper in the current embodiment is coated with a liquid-impervious or liquid-resistant coating. In the current embodiment, the coating is a Michelman water-resistant coating, such as X300, although other Michelman coatings may be used in various embodiments. The coating may be various materials in various embodiments but may include wax, polymer, urethane, elastomer, plastic, and other similar materials. If the construction of the packaging is of a liquid- or fluid-resistant material, a separate coating may not be necessary in some embodiments.

The packaging 100 includes four side panels 110,120,130,140. Although there are four side panels 110,120,130,140 in the current embodiment, any number of side panels may be used in various embodiments. In the current embodiment, side panels 120 and 140 include the same dimensions while side panels 110 and 130 include the same dimensions, although side panels 110 and 130 do not include the same dimensions as side panels 120 and 140. This results in a rectangular-shaped box packaging 100 in an assembled state. Each side panel 110,120,130,140 includes a top end 112,122,132,142, a bottom end 114,124,134,144, a first lateral end 116,126,136,146, a second lateral end 118,128,138,148, an inner surface 117,127,137,147, and an outer surface 119,129,139,149 (not shown). References to "top" and "bottom" in this disclosure are intended to refer to the packaging 100 in an assembled state.

A bottom panel 150 is included and connected to the bottom end 114,124,134,144 of each side panel 110,120,130,140. The bottom panel 150 includes a back end 152, a front end 154, a left end 156, a right end 158, an inner surface 157, and an outer surface 159 (not shown). The connections between the bottom panel 150 and the side panels 110,120,130,140 are bend lines in the current embodiment. Bend lines to which this disclosure refers are designed as weakened regions, and may include a crease, a perforation, a series of perforations, or another arrangement to weaken the area of the bend line.

In the packaging 100 of the current embodiment, all features are connected by bend lines. As such, the blank of FIG. 1 is a one-piece blank wherein no features or lines shown are disconnected other than the outer edges.

The packaging 100 includes a first top panel 160 and a second top panel 170. Each top panel 160,170 includes an outer end 162,172, a connected end 164,172, a first lateral end 166,176, a second lateral end 168,178, an inner surface 167,177, and an outer surface 169,179 (not shown). Each top panel 160,170 is connected by its connected end 164,174 to the top end 112,132 of the side panel 110,130 adjacent to the top panel 160,170.

The packaging 100 includes a first top flap 180 and a second top flap 190. Each top flap 180,190 includes an outer end 182,192, a connected end 184,194, a first lateral end 186,196, a second lateral end 188,198, an inner surface 187,197, and an outer surface 189,199 (not shown). Each top flap 180,190 is connected by its connected end 184,194 to the top end 122,142 of the side panel 120,140 adjacent to the top flap 180,190. The connections between each side panel 110,120,130,140 and the respective top panel 160,170 or top flap 180,190 are bend lines in the current embodiment.

In the current embodiment, three panels are located between each side panel 110,120,130,140. A first bending panel 210*a,b,c,d* is connected to each first lateral end 116, 126,136,146. Each first bending panel 210*a,b,c,d* includes a side panel end 212*a,b,c,d*, a triangular panel end 214*a,b,c,d*, a first outer end 216*a,b,c,d*, a second outer end 218*a,b,c,d*, an inner surface 217*a,b,c,d*, and an outer surface 219*a,b,c,d* (not shown).

Connected to each triangular panel end 214*a,b,c,d* is a triangular panel 230*a,b,c,d*. Each triangular panel 230*a,b,c,d* includes a first end 232*a,b,c,d*, a second end 234*ab,c,d*, an outer end 236*a,b,c,d*, an inner surface 237*a,b,c,d*, and an outer surface 239*a,b,c,d* (not shown). Each second bending panel 220*a,b,c,d* includes a side panel end 222*a,b,c,d*, a triangular panel end 224*a,b,c,d*, a first outer end 226*a,b,c,d*, a second outer end 228*a,b,c,d*, an inner surface 227*a,b,c,d*, and an outer surface 229*a,b,c,d* (not shown).

Connected to each second end 234*a,b,c,d* is a second bending panel 220*a,b,c,d*. The second bending panel 220*a,b,c,d* is connected to each second lateral end 148,118,128, 138.

Figure 2:
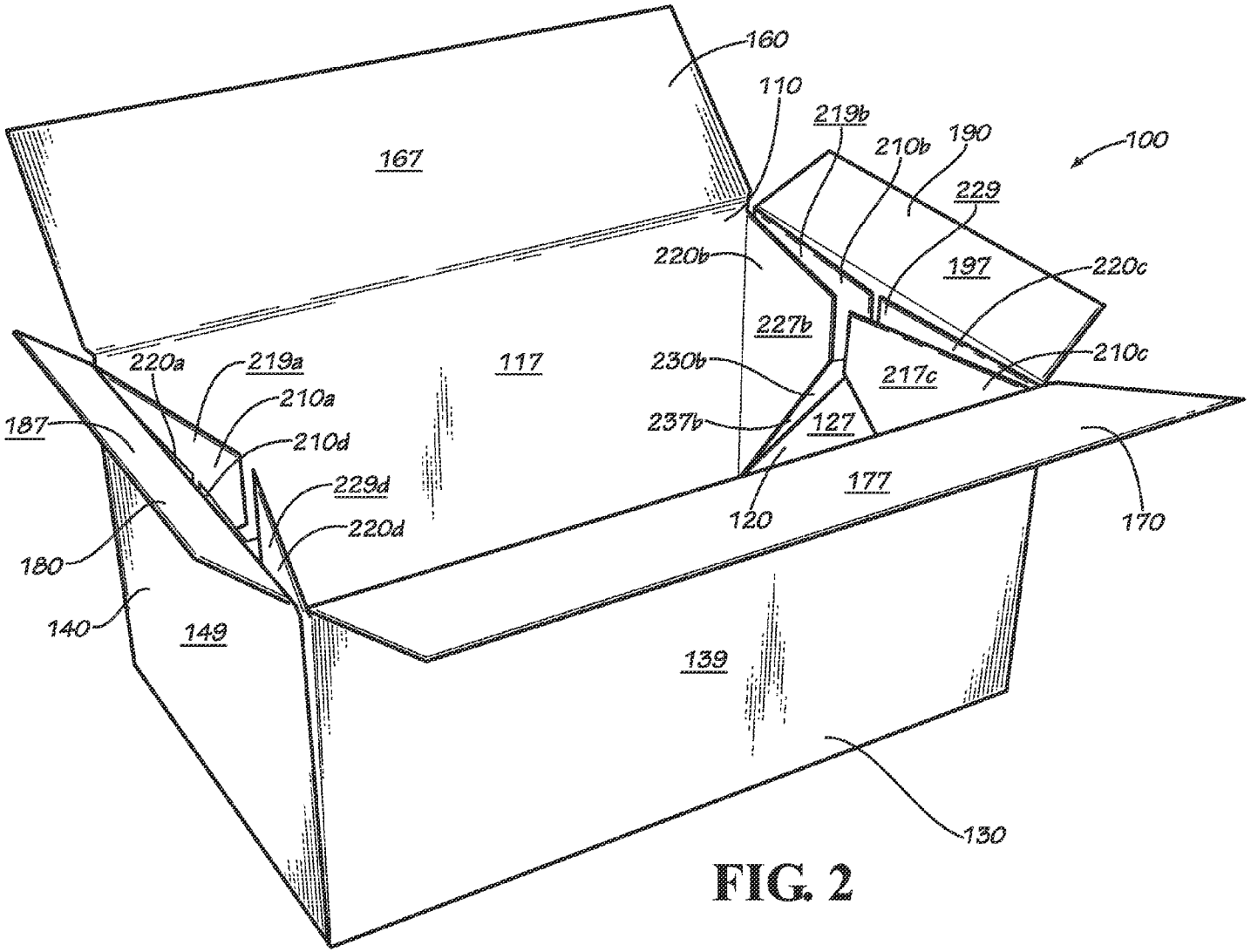
FIG. 2 is a perspective view of the packaging of FIG. 1 formed into an assembled state.
Figure 3:
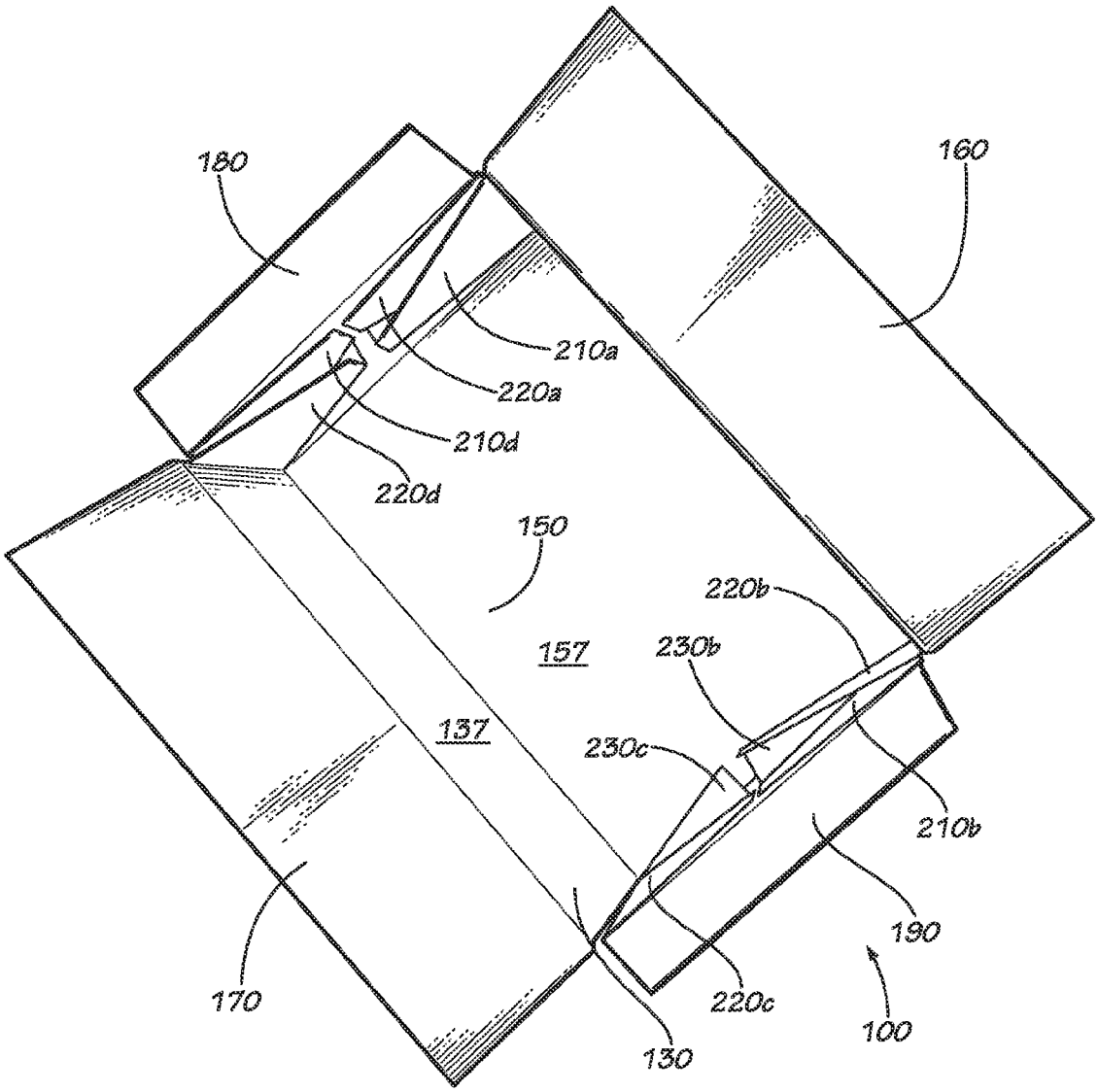
FIG. 3 is a top perspective view of the packaging in assembled state of FIG. 2.

As seen in assembled state in FIGS. 2 and 3, the packaging 100 is assembled by folding the side panels 110,120, 130,140 in an orthogonal arrangement with respect to the bottom panel 150. Each first bending panel 210*a,b,c,d*, triangular panel 230*a,b,c,d*, and second bending panel 220*a,b,c,d* are folded to the inside of the packaging 100 so that the panels 210,220,230 are proximate the inner surfaces 117, 127,137,147. The outer surfaces of each first bending panel 210*a,b,c,d* and generally faces and opposes each corresponding second bending panel 220*a,b,c,d*.

In the current embodiment, when the packaging 100 is in assembly, the bending panels 210,220 and triangular panels 230 generally would protrude into the center of the packaging 100. The protrusion is bent toward the side panels 120,140. This helps prevent the panels 210,220,230 from interfering with items in the center of the packaging 100. The panels 210,220,230 are arranged so that inner surfaces 227*a* and 217*d* contact inner surface 147 and, similarly, so that inner surfaces 217*b* and 227*c* contact inner surface 127. The contacts described are glued together to maintain the packaging 100 in the assembled state.

In assembly line configuration, the packaging 100 may be configured such that it can be assembled around an assembly-line product without removing the product from the line. For example, if a manufacturing process creates a product, the product may be placed onto the bottom panel 150 on the assembly line such that the product contacts the inner surface 157. A packager—which may be a line worker or a packing machine—may then fold the packaging 100 as described above so that the side panels 110,120,130,140 are orthogonal to the bottom panel 150. The packager then may glue the bending panels 210,220 to the side panels 110,120, 130,140 as described above. Optionally, the packager may then fold the top flaps 180,190 and top panels 160,170 to enclose the product, gluing or taping the packaging 100 together.

In the depicted configuration, first bending panel 210*a*, second bending panel 220*d*, second bending panel 220*b*, first bending panel 210*c*, and all four triangular panels 230*a,b,c,d* protrude into the interior of the packaging 100, even though the packaging is in its assembled state. This configuration allows the first bending panels 210*a,c*, the second bending panels 220*b,d*, and the triangular panels 230*a,b,c,d* to provide additional strength and support the top panels 160,170 and top flaps 180,190 when they are folded over to seal the packaging 100. This additional support can result in greater strength when stacking other items (such as additional boxes and packaging 100) on top of packaging 100. One of skill in the art would understand that the thickness and size of these features can be changed to provide additional or reduced strength, depending on specifications.

When assembled, the packaging 100 includes no seams that are vertically below the top ends 112,122,132,142 of the packaging 100. The coating on the corrugated cardboard is generally impervious to liquids to some degree, and thus prevents liquids from penetrating into the corrugated paper. As such, so long as the packaging 100 is not overturned and is not punctured, liquid cannot escape from inside the packaging 100, and external contaminants cannot penetrate the packaging.

Although the top panels 160,170 and the top flaps 180,190 of the current embodiment provide one enclosure for the packaging 100, other enclosures should be considered included within this disclosure. For example, in some embodiments, the top flaps 180,190 may be larger and may be configured to wrap around the outside of the packaging 100 to provide a sealable connection when glue is applied.

Although a glued configuration is disclosed in the current embodiment, glue may be replaced with other connections in various embodiments, including mechanical connections, taped configurations, stapled configurations, key/fit configurations, and welding or integrated configurations, among others. In the current embodiment, eight glue points—two per connection—secure the packaging. In other embodiment, more or fewer glue points or glue configurations may be used. Although all panels are connected in the current embodiment, various embodiments may include panels disconnected from each other or from various other panels so long as the connection is are in leak-resistant arrangement sufficient to contain products without substantial leakage.

It should be emphasized that the embodiments described herein are merely possible examples of implementations, merely set forth for a clear understanding of the principles of the present disclosure. Many variations and modifications may be made to the described embodiment(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

One should note that conditional language, such as, among others, "can," "could," "might," or "may," unless specifically stated otherwise, or otherwise understood within the context as used, is generally intended to convey that certain embodiments include, while alternative embodiments do not include, certain features, elements and/or steps. Thus, such conditional language is not generally intended to imply that features, elements and/or steps are in any way required for one or more particular embodiments or that one or more particular embodiments necessarily include logic for deciding, with or without user input or prompting, whether these features, elements and/or steps are included or are to be performed in any particular embodiment.

Various implementations described in the present disclosure may include additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims.

The invention claimed is:

1. A blank formable into leak-resistant packaging, the blank comprising:

a bottom panel;

at least two side panels, including a first side panel adjacent to a second side panel, each side panel in leak-resistant arrangement with the bottom panel; and at least one support in leak-resistant arrangement with bottom panel and with the first side panel and the second side panel, each support including a first bending panel, a second bending panel, and a triangular panel, each bending panel including a first outer end and a second outer end, the first outer end of each bending panel angled at an angle of between 0 and 180 degrees relative to the second outer end, each first outer end and second outer end of the bending panels being outer edges of the blank, the first bending panel connected to the first side panel by a first bend line comprising a first crease, the second bending panel connected to the second side panel by a second bend line comprising a second crease, the triangular panel between the first bending panel and the second bending panel, the triangular panel connected to the first bending panel by a third bend line comprising a third crease and the triangular panel connected to the second bending panel by a fourth bend line comprising a fourth crease, the triangular panel including an outer end extending between the second outer end of the first bending panel and the second outer end of the second bending panel, the outer end of the triangular panel angled at an angle of between 0 and 180 degrees relative to the first outer end of the first bending panel and relative to the first outer end of the second bending panel, the outer end of the triangular panel being an outer edge of the blank, each support bendable between the first side panel and the second side panel to bring an inner surface of the first bending panel into facing contact with and fixably attachable to an inner surface of the first side panel by bending the first bending panel towards the first side panel along the first bend line, thereby angling the second bending panel apart from the second side panel-by bending the second bending panel away from the second side panel along the second bend line.

2. The blank of claim 1, wherein the bottom panel is connected to each side panel and wherein each side panel is connected to at least one support.

3. The blank of claim 1, further comprising at least one top panel, each top panel arranged to be supported by the at least one support.

4. The blank of claim 1, wherein the at least one support includes four supports.

5. The blank of claim 4, wherein the supports are arranged to support to at least one additional packaging in stacked arrangement on top of the packaging.

6. The blank of claim 5, wherein an inner surface of each panel includes a leak-resistant coating.

7. The blank of claim 6, wherein the leak-resistant coating is a Michelman coating.

8. The blank of claim 1, wherein:

each bending panel and each of the at least two side panels have an inner surface; and the one of the first bending panel and the second bending panel includes an adhesive material.

9. A blank formable into packaging, the blank comprising:

at least one bottom panel;

a first side panel connected to a one of the at least one bottom panel;

a second side panel connected to a one of the at least one bottom panel; and at least one support connected to the first side panel and the second side panel, each support including a first bending panel having a first outer end and a second outer end, the first outer end of the first bending panel angled relative to the second outer end of the first bending panel at an angle of between 0 and 180 degrees, the first outer end and the second outer end of the first bending panel being outer edges of the blank, a second bending panel having a first outer end and a second outer end, the first outer end of the second bending panel angled relative to the second outer end of the second bending panel at an angle of between 0 and 180 degrees, the first outer end and the second outer end of the second bending panel being outer edges of the blank, and a triangular panel, the first bending panel connected to the first side panel by a first bend line, the second bending panel connected to the second side panel by a second bend line, the triangular panel connected to the first bending panel by a third bend line and to the second bending panel by a fourth bend line, the third bend line and the fourth bend line being the only bend lines between the first bend line and the second bend line, the first bending panel intersecting the triangular panel, the first outer end and the second outer end of the first bending panel together extending from the first side panel to the triangular panel, the first outer end and the second outer end of the second bending panel together extending from the second side panel to the triangular panel, each triangular panel between the first bending panel and the second bending panel and including an outer end extending from the second outer end of the first bending panel to the second outer end of the second bending panel, the outer end of the triangular panel angled at an angle of between 0 and 180 degrees relative to the first outer end of the first bending panel and relative to the first outer end of the second bending panel, the outer end of the triangular panel being an outer edge of the blank, the length of the outer end of the triangular panel shorter than each of the outer ends of the first bending panel and shorter than each of the outer ends of the second bending panel, wherein a surface of the blank is coated with a leak-resistant coating.

10. The blank of claim 9, wherein each connection between panels includes a bend line.

11. The blank of claim 9, wherein the blank is sized to enclose and package an intended article of manufacture.

12. The blank of claim 9, wherein the blank includes at least one top panel.

13. The blank of claim 12, wherein each top panel is connected to a side panel.

14. The blank of claim 9, wherein a length of the outer end of the triangular panel less than a length defined by the first outer end and second outer end of the first bending panel and less than a length defined by the first outer end and second outer end of the second bending panel.

15. A method of packaging, the method comprising:

obtaining a blank formable into packaging, the blank including:

a bottom panel;

at least two side panels connected to the bottom panel, including a first side panel and a second side panel, each at least two side panels including an inner surface and the first side panel being adjacent to the second side panel;

at least two bending panels, a first bending panel connected to the first side panel at a first bend line and a second bending panel connected to the second side panel at a second bend line, each bending panel including a first outer end and a second outer end, each first outer end angled relative to each second outer end at a non-zero angle; and a triangular panel, the triangular panel between the first bending panel and the second bending panel and including an outer end extending from the second outer end of the first bending panel to the second outer end of the second bending panel, the triangular panel connected to the first bending panel by a third bend line and the triangular panel connected to the second bending panel by a fourth bend line, wherein a surface of the blank is coated with a leak-resistant coating;

placing an article of manufacture on the blank; and forming the blank into packaging around the article of manufacture by:

initially bending the two bending panels and the triangular panel to protrude into an interior of the packaging; and subsequently bending the first bending panel at the first bend line so that the first bending panel is angularly offset from the first side panel, so that an inner surface of the second bending panel is in facing contact with an inner surface of the second side panel, and so that an outer surface of the first bending panel faces an outer surface of the second bending panel; a portion of the outer surface of the first bending panel proximate to the first bend line offset from a portion of the outer surface of the second bending panel proximate to the second bend line by the triangular panel.

16. The method of claim 15, wherein each blank includes at least one support.

17. The method of claim 16, wherein each blank includes at least one top panel.

18. The method of claim 17, further comprising the step of arranging at least one support to support at least one top panel.

19. The method of claim 18, wherein each the article of manufacture requires leak-resistant packaging.

20. A method of packaging, the method comprising:

placing a product on a blank, the blank comprising:

a bottom panel;

a first side panel connected to the bottom panel;

a second side panel connected to the bottom panel, the second side panel being adjacent to the first side panel;

a first bending panel connected to the first side panel at a first bend line;

a second bending panel connected to the second side panel at a second bend line; and a triangular panel, the triangular panel between the first bending panel and the second bending panel, the triangular panel connected to the first bending panel by a third bend line and the triangular panel connected to the second bending panel by a fourth bend line; and forming the blank into packaging around the product by:

initially bending the first bending panel at the first bend line and the second bending panel at the second bend line to position the first bending panel, the second bending panel, and the triangular panel into an interior of the packaging; and subsequently bending the first bending panel and the second bending panel so that an inner surface of the second bending panel is in facing contact with the inner surface of the second side panel and so that an outer surface of the first bending panel faces an outer surface of the second bending panel; a portion of the outer surface of the first bending panel proximate to the first bend line offset from a portion of the outer surface of the second bending panel proximate to the second bend line by the triangular panel.

21. The method of claim 20, wherein the first bending panel comprises a first outer end and a second outer end, the first outer end angled relative to the second outer end at an angle of between 0 and 180 degrees;

the second bending panel comprises a first outer end and a second outer end, the first outer end angled relative to the second outer end at an angle of between 0 and 180 degrees; and the triangular panel comprises an outer end extending from the second outer end of the first bending panel to the second outer end of the second bending panel;

wherein forming the blank into packaging around the product comprises the second outer end of the first bending panel, the second outer end of the second bending panel, and the outer end of the triangular panel defining a U-shaped gap, the U-shaped gap comprising each of the second outer end of the first bending panel and the second outer end of the second bending panel oriented in a vertical orientation and the outer end of the triangular panel oriented in a horizontal orientation.

22. The method of claim 21, wherein the first outer end of the first bending panel is parallel with a top end of the first side panel before forming the blank into packaging around the product and extends from the first bend line, the second outer end of the first bending panel extending from the first outer end of the first bending panel; and the first outer end of the second bending panel is parallel with a top end of the second side panel before forming the blank into packaging around the product and extends from the second bend line, the second outer end of the second bending panel extending from the first outer end of the second bending panel.

23. The method of claim 22, wherein the outer end of the triangular panel is angled at an angle of between 0 and 180 degrees relative to the first outer end of the first bending panel and relative to the first outer end of the second bending panel before forming the blank into packaging around the product.

24. The method of claim 20, wherein each of the first bend line, the second bend line, the third bend line, and the fourth bend line comprises a crease.

* * * * *